US006276445B1

(12) United States Patent
Sasano et al.

(10) Patent No.: US 6,276,445 B1
(45) Date of Patent: Aug. 21, 2001

(54) HEAT EXCHANGER WITH HEAT INSULATING MEMBER DISPOSED BETWEEN CONDENSER AND RADIATOR TANKS

(75) Inventors: Norihisa Sasano, Ama-gun; Tatsuo Sugimoto, Okazaki; Takaaki Sakane, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/449,433

(22) Filed: Nov. 24, 1999

(30) Foreign Application Priority Data

Dec. 2, 1998 (JP) ..... 10-343323
Jul. 23, 1999 (JP) ..... 11-209590

(51) Int. Cl.[7] ..... F28F 9/007
(52) U.S. Cl. ..... 165/135; 165/140; 165/149
(58) Field of Search ..... 165/135, 140, 165/149

(56) References Cited

U.S. PATENT DOCUMENTS 5,186,243 * 2/1993 Halstead ..... 165/135
5,186,246 * 2/1993 Halstead ..... 165/140
5,535,819 * 7/1996 Matsuura ..... 165/149
5,992,514 * 11/1999 Sugimoto et al. ..... 165/135
6,095,239 * 8/2000 Makino et al. ..... 165/140

FOREIGN PATENT DOCUMENTS 2-92492 * 7/1990 (JP) ..... 165/149

* cited by examiner

*Primary Examiner*—Allen Flanigan
(74) *Attorney, Agent, or Firm*—Harness, Dickey & Pierce, PLC

(57) ABSTRACT

A heat exchanger has a condenser having a condenser tank and a radiator having a radiator tank. An end of the condenser tank in a longitudinal direction thereof is closed by a condenser tank cap, and an end of the radiator tank in a longitudinal direction thereof is closed by a radiator tank cap. A bracket through which the heat exchanger is mounted to a vehicle is secured to the end of the radiator tank in the longitudinal direction thereof so that a cavity is formed between the radiator tank cap and the bracket. As a result, heat is restricted from being transmitted from the radiator tank to the bracket. Therefore, heat is restricted from being transmitted from the radiator to the condenser through the bracket to maintain heat exchange performance of the condenser.

12 Claims, 5 Drawing Sheets

HEAT EXCHANGER WITH HEAT INSULATING MEMBER DISPOSED BETWEEN CONDENSER AND RADIATOR TANKS

CROSS REFERENCE TO RELATED APPLICATIONS

This application relates to and claims priority from Japanese Patent Application Nos. 10-343323 filed on Dec. 2, 1998 and 11-209590 filed on Jul. 23, 1999, the contents of which are hereby incorporated by reference.

BACKGROUND OF THE INVENTION

1. Field of the Invention

The present invention relates generally to automotive air conditioners, and particularly to an automotive air conditioner heat exchanger having a condenser and a radiator for cooling engine cooling water.

2. Related Art

JP-A-10-170185 discloses a heat exchanger having a condenser and a radiator. An end of a header tank of the condenser in a longitudinal direction thereof and an end of a header tank of the radiator in a longitudinal direction thereof are closed by a single header cap. The header cap is also used as a bracket through which the heat exchanger is mounted to a vehicle.

However, in the heat exchanger, heat may be transmitted from the radiator to the condenser through the header cap. As a result, heat exchange performance of the condenser may deteriorate.

SUMMARY OF THE INVENTION

In view of the foregoing problems, it is an object of the present invention to provide a heat exchanger having first and second heat exchangers for improving heat exchange performance.

According to the present invention, a heat exchanger unit has a first heat exchanger and a second heat exchanger. The first heat exchanger has a plurality of first tubes and a first tank communicating with each first tube. The second heat exchanger is disposed at a downstream air side of the first heat exchanger, and has a plurality of second tubes and a second tank communicating with each second tube. A holding member is secured to an end of at least one of the first tank and the second tank in a longitudinal direction thereof for holding the first heat exchanger and the second heat exchanger. Further, a heat insulating member is disposed between the holding member and an end of at least one of the first tank and the second tank in the longitudinal direction thereof for restricting heat from being transmitted from the at least one of the first tank and the second tank to the holding member.

As a result, heat is restricted from being transmitted between the first heat exchanger and the second heat exchanger through the holding member, to maintain heat exchange performance of the heat exchanger.

Preferably, the heat insulating member includes a cavity. As a result, heat is restricted from being transmitted between the first heat exchanger and the second heat exchanger by the cavity.

Preferably, the holding member has a heat transmission restriction member for restricting heat transmission within the holding member. As a result, heat is further restricted from being transmitted between the first heat exchanger and the second heat exchanger through the holding member.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention are described hereinafter with reference to the accompanying drawings.

(First Embodiment)

A first preferred embodiment of the present invention will be described with reference to FIGS. 1–6.

In the first embodiment, the present invention is applied to a heat exchanger having a condenser as a first heat exchanger and a radiator as a second heat exchanger. The condenser is used for a refrigerant cycle of a vehicle air conditioner, and the radiator is disposed at a downstream air side of the condenser and cools engine cooling water.

Figure 1:
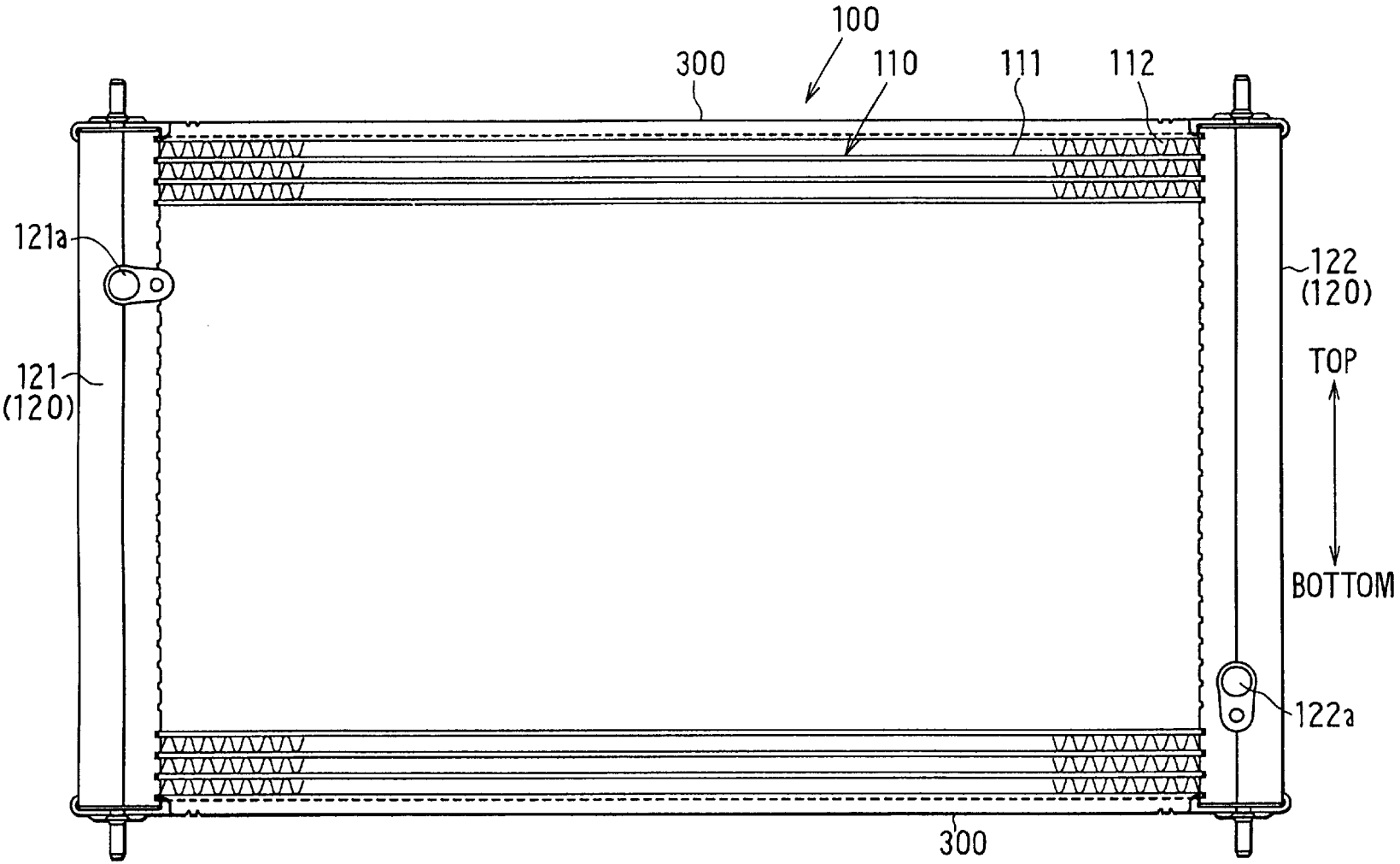
FIG. 1 is a front view showing a condenser of a heat exchanger according to a first preferred embodiment of the present invention.

As shown in FIG. 1, a condenser 100 has plural flat condenser tubes 111 through which refrigerant flows, and plural corrugated condenser fins 112 disposed between adjacent condenser tubes 111 to facilitate heat exchange of refrigerant. Each of the condenser fins 112 is bonded to the tubes 111 using brazing material clad on outer surfaces of the condenser tubes 111. The condenser tubes 111 and the condenser fins 112 form a condenser core 110 which condenses (cools) refrigerant. In FIG. 1, the condenser 100 is viewed from an upstream air side.

A first condenser tank 121 is disposed at one end of each condenser tube 111 in a longitudinal direction thereof. The first condenser tank 121 extends in a direction perpendicular to the longitudinal direction of each condenser tube 111, and communicates with each condenser tube 111. The first condenser tank 121 has a first connector 121*a* connected to an outlet of a compressor (not shown). Refrigerant discharged from the compressor flows into the first condenser tank 121, and is distributed to each condenser tube 111.

A second condenser tank 122 is disposed at the other end of each condenser tube 111 in the longitudinal direction thereof. The second condenser tank 122 also extends in the direction perpendicular to the longitudinal direction of each condenser tube 111, and communicates with each condenser tube 111. Refrigerant discharged from each condenser tube 111 is collected into the second condenser tank 122. The second condenser tank 122 has a second connector 122*a* connected to a decompressor (not shown). Hereinafter, the first and second condenser tanks 121, 122 are collectively referred to as a condenser tank 120.

Each end of the condenser tank 120 in a longitudinal direction thereof is closed by a condenser tank cap 123. The condenser tank cap 123 is bonded to the condenser tank 120 using brazing material clad on an outer surface of the condenser tank 120 and an inner surface of the condenser tank cap 123. Each of the condenser tubes 111 is bonded to the condenser tank 120 using brazing material clad on the outer surface of the condenser tank 120.

Figure 2:
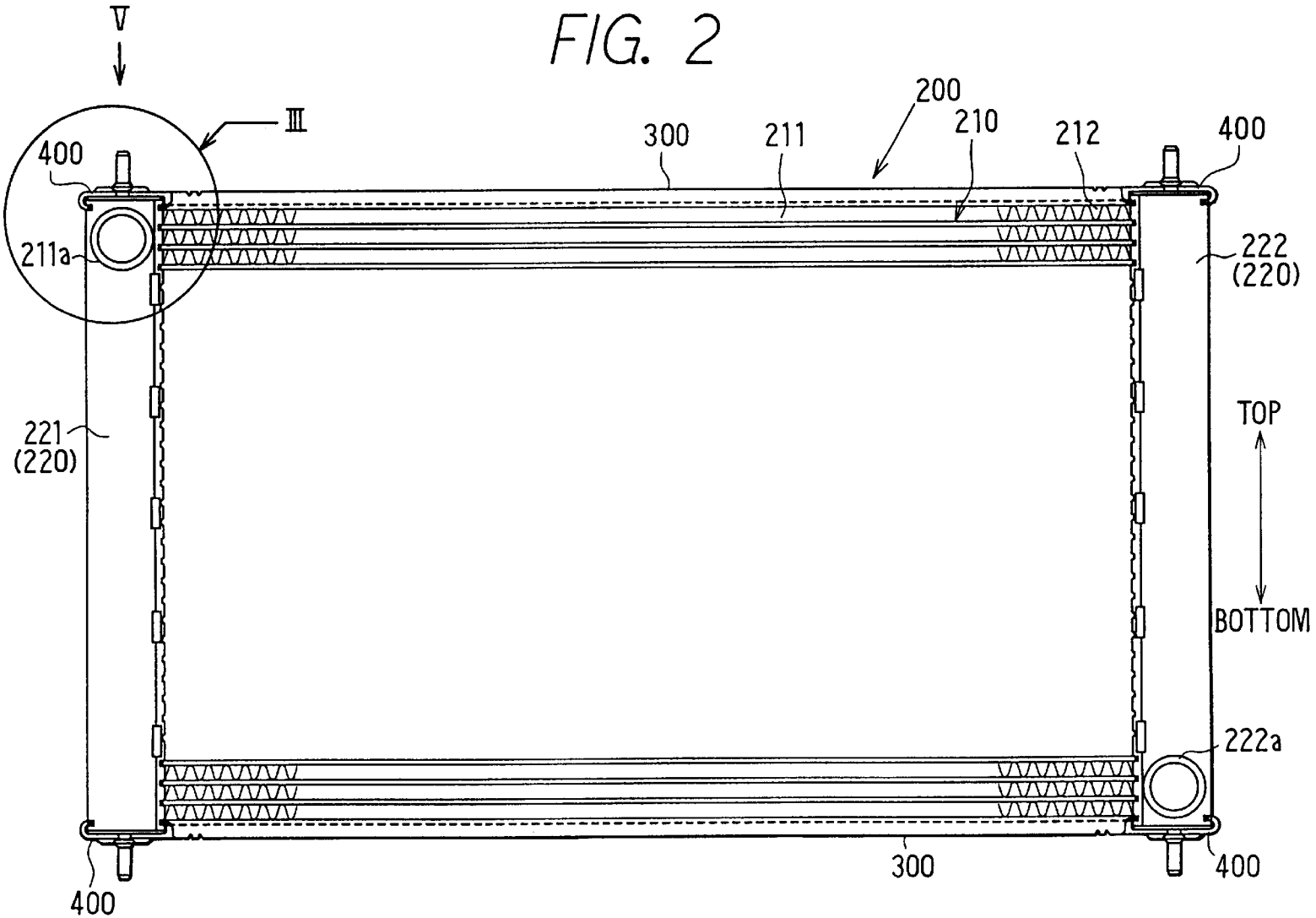
FIG. 2 is a front view showing a radiator of the heat exchanger according to the first embodiment.
Figure 3:
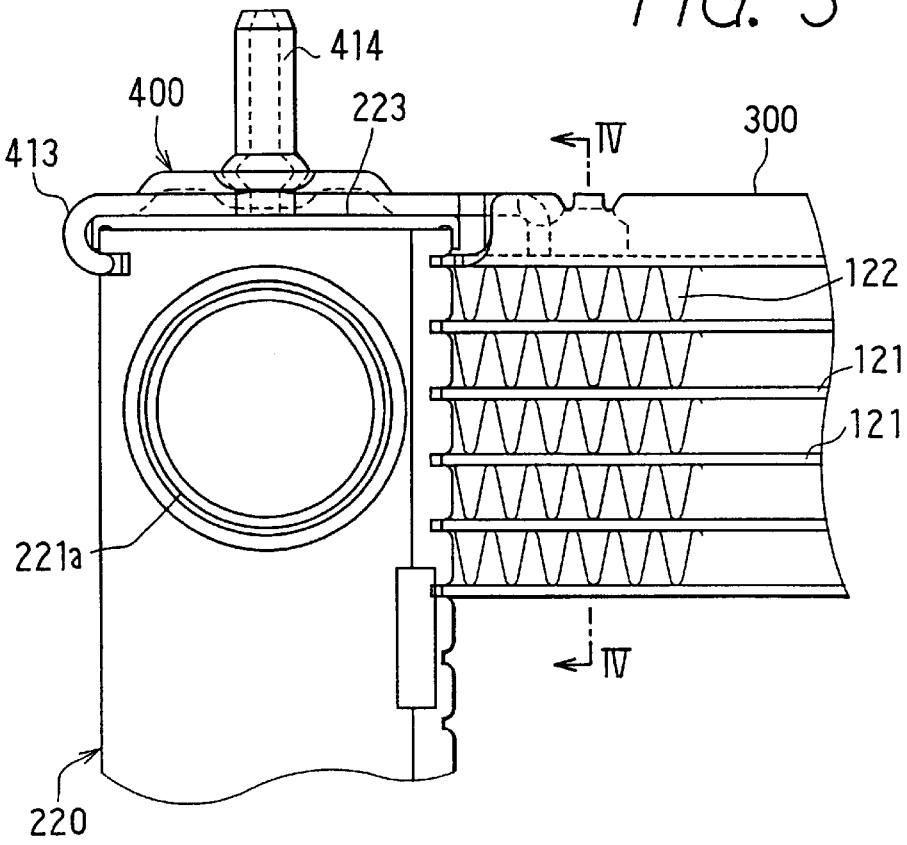
FIG. 3 is an enlarged view showing a portion indicated by arrow III in FIG. 2.

As shown in FIGS. 2 and 3, a radiator 200 has plural flat radiator tubes 211 through which engine cooling water flows, and plural corrugated radiator fins 212 disposed between adjacent radiator tubes 211 to facilitate heat exchange of engine cooling water. In FIG. 2, the radiator 200 is viewed from the downstream air side.

Figure 4:
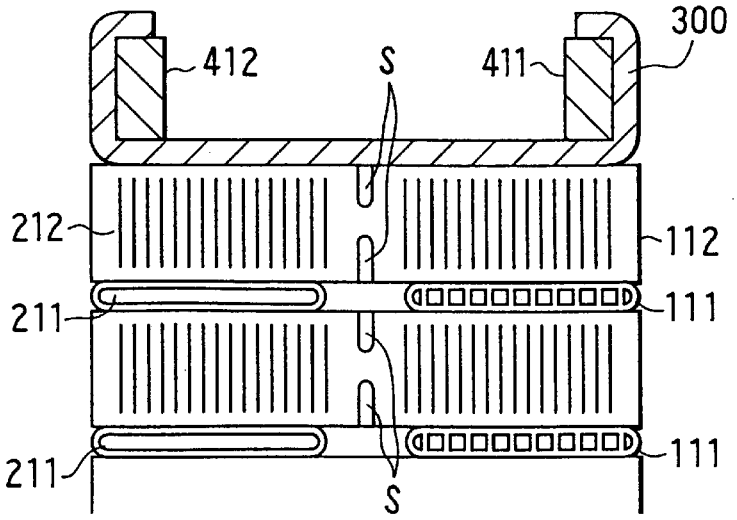
FIG. 4 is a sectional view taken along line IV—IV in FIG. 3.

As shown in FIG. 4, the radiator fins 212 are formed integrally with the condenser fins 112. A slit S is formed between each radiator fin 212 and condenser fin 112 to restrict heat transmission from the radiator fin 212 to the condenser fin 112. Each radiator fin 212 is bonded to the radiator tubes 211 using brazing material clad on the outer surfaces of the radiator tubes 211. The radiator tubes 211 and the radiator fins 212 form a radiator core 210 which cools engine cooling water.

Referring back to FIG. 2, a first radiator tank 221 is disposed at one end of each radiator tube 211 in a longitudinal direction thereof. The first radiator tank 221 extends in parallel with a longitudinal direction of the condenser tank 120, and communicates with each radiator tube 211. The first radiator tank 221 has a first connection pipe 221*a* connected to an engine cooling water outlet of a vehicle engine (not shown). Engine cooling water discharged from the vehicle engine flows into the first radiator tank 221, and is distributed to each radiator tube 211.

A second radiator tank 222 is disposed at the other end of each radiator tube 211 in the longitudinal direction thereof. The second radiator tank 222 also extends in parallel with the longitudinal direction of the condenser tank 120, and communicates with each radiator tube 211. Engine cooling water discharged from each radiator tube 211 is collected into the second radiator tank 222. The second radiator tank 222 has a second connection pipe 222*a* connected to an engine cooling water inlet of the engine. Hereinafter, the first and second radiator tanks 221, 222 are collectively referred to as a radiator tank 220.

Each end of the radiator tank 220 in a longitudinal direction thereof is closed by a radiator tank cap 223. The radiator tank cap 223 is bonded to the radiator tank 220 using brazing material clad on an outer surface of the radiator tank 220 and an inner surface of the radiator tank cap 223. Each of the radiator tubes 211 is bonded to the radiator tank 220 using brazing material clad on the outer surface of the radiator tank 220.

As shown in FIGS. 1 and 2, a side plate 300 is attached to the heat exchanger to extend in the longitudinal direction of the condenser and radiator tubes 111, 211 for reinforcing the condenser core 110 and the radiator core 210. As shown in FIG. 4, the side plate 300 has a C-shaped cross section and contacts both the condenser core 110 and the radiator core 210.

Figure 6:
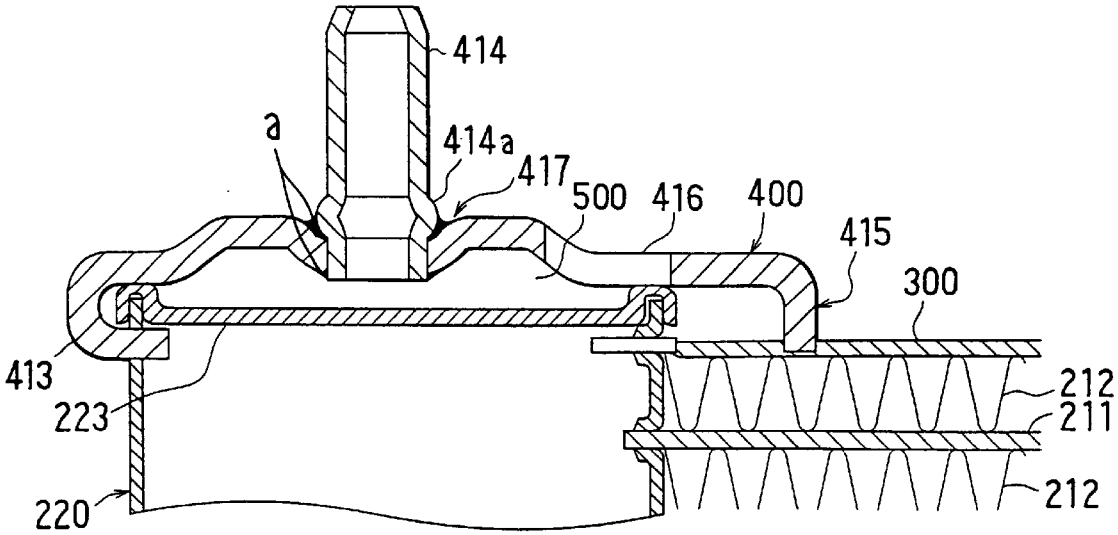
FIG. 6 is a sectional view taken along line VI—VI in FIG. 5.

As shown in FIGS. 1, 2, and 3, a holding member or bracket 400 is disposed at each end of the condenser tank 120 and the radiator tank 220 in the longitudinal direction thereof. The heat exchanger is secured to a vehicle body through the bracket 400. As shown in FIG. 6, a cavity 500 is formed between the bracket 400 and the radiator tank cap 223 to restrict heat from being transmitted from the radiator tank 220 to the bracket 400.

Figure 5:
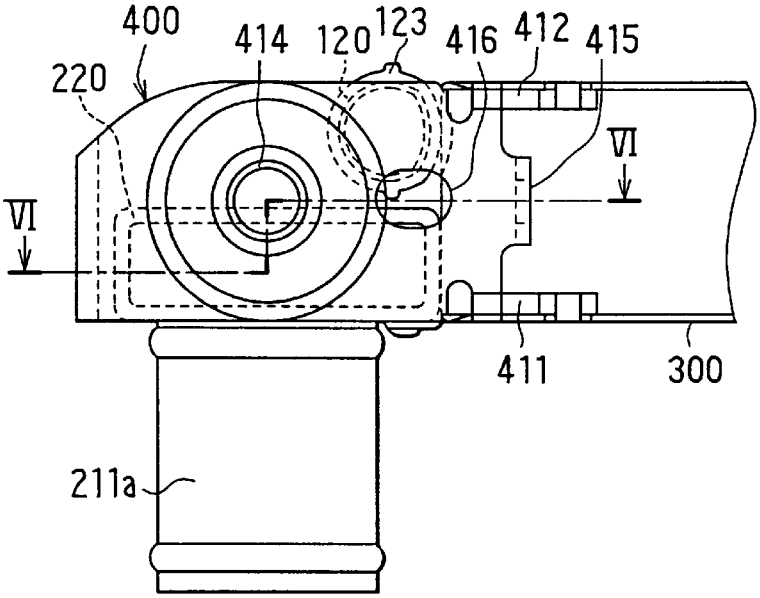
FIG. 5 is a top view taken from arrow V in FIG. 2.

As shown in FIG. 5, the bracket 400 has a first arm portion 411 and a second arm portion 412 extending toward the side plate 300. The first and second arm portions 411, 412 are bonded to the side plate 300 using brazing material clad on inner and outer surfaces of the bracket 400.

As shown in FIG. 6, the bracket 400 has a tank insertion portion 413 inserted into the radiator tank 220 at an opposite end of the bracket 400 with respect to the first and second arm portions 411, 412. The tank insertion portion 413 is bonded to the radiator tank 220 by brazing. As shown in FIGS. 5 and 6, the bracket 400 also has a plate insertion portion 415 disposed between the first and second arm portions 411, 412 and inserted into the side plate 300. Therefore, the bracket 400 is tentatively secured to the heat exchanger by respectively inserting the tank insertion portion 413 and the plate insertion portion 415 into the radiator tank 200 and the side plate 300.

Further, as shown in FIG. 5, the bracket 400 has a through hole 416 at a position where the radiator tank 220 and the condenser tank 120 are in close proximity to each other. As a result, heat transmission within the bracket 400 is restricted.

Furthermore, as shown in FIG. 6, a pin member 414 is attached to a center portion of the bracket 400. The pin member 414 is inserted into and secured to a stay of the vehicle to mount the heat exchanger to the vehicle. The pin member 414 has a flange portion 414*a* formed to protrude outwardly along an outer circumference of the pin member 414. The pin member 414 is positioned by the flange portion 414*a* and is bonded to both inner and outer surfaces of the bracket 400 by brazing. In FIG. 6, a portion indicated by "a" shows a brazing area. A recess portion 417 is formed by "burring" in the bracket 400 to be recessed toward the radiator tank cap 223. The pin member 414 is inserted into the recess portion 417 so that the pin member 414 is seated on the bracket 400 in a more stabilized manner.

According to the first embodiment, the cavity 500 is formed between the bracket 400 and the radiator tank cap 223. As a result, heat is restricted from being transmitted from the radiator tank 220 to the bracket 400. Therefore, heat is restricted from being transmitted from the high temperature radiator tank 220 to the low temperature condenser tank 120 through the bracket 400 to maintain heat exchange performance of the condenser 100. As a result, overall heat exchange performance of the heat exchanger is improved.

Further, in the first embodiment, the through hole 416 is formed in the bracket 400 at a position where the condenser tank 120 and the radiator tank 220 are in close proximity to each other. Therefore, heat is further restricted from being transmitted from the radiator 200 to the condenser 100 through the bracket 400.

Further, in the first embodiment, the pin member 414 is attached to the bracket 400. Therefore, heat transmission within the bracket 400 is further restricted.

Further, in the first embodiment, the bracket 400 is secured to the heat exchanger with the tank insertion portion 413 being inserted into the radiator tank 220. Therefore, the bracket 400 is firmly secured to the heat exchanger. Also, the first and second arm portions 411, 412 are secured to the side plate 300 to firmly secure the bracket 400 to the heat exchanger.

Further, in the first embodiment, the bracket 400 is fastened to the heat exchanger through the tank insertion portion 413 and the plate insertion portion 415 before brazing. Therefore, the bracket 400 is restricted from being shifted from the radiator tank 220 and the side plate 300 before being bonded to the heat exchanger by brazing.

Further, the bracket 400 is bonded to the heat exchanger to connect the radiator tank 220 and the side plate 300. Therefore, the radiator tank 220 and the side plate 300 are connected with each other more securely through the bracket 400, and mechanical strength of the double heat exchange is improved.

(Second Embodiment)

A second preferred embodiment of the present invention will be described with reference to FIG. 7. In this embodiment, components which are substantially the same as those in the previous embodiment are assigned the same reference numerals, and the explanation thereof is omitted. In the second embodiment, a bracket is separated from the radiator tank 220, and is fastened to the side plate 300 by a bolt B.

Figure 7:
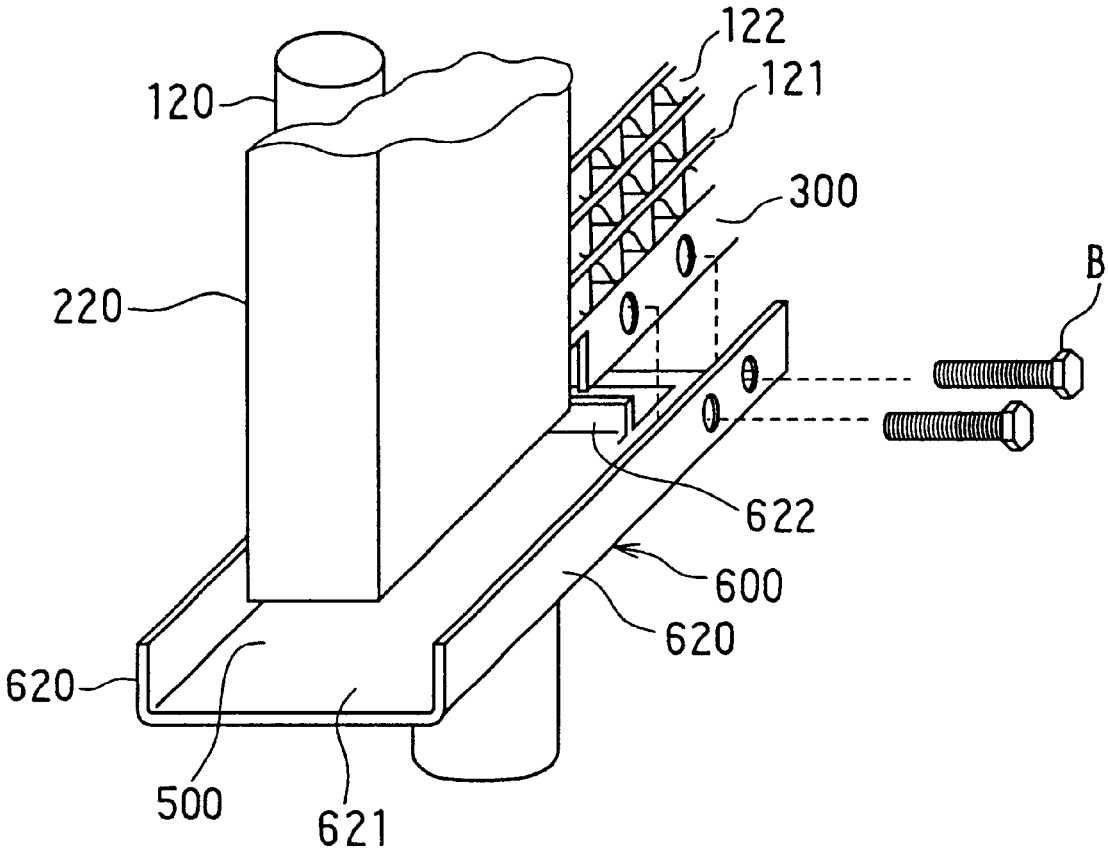
FIG. 7 is a partial perspective view showing a heat exchanger according to a second preferred embodiment of the present invention.

As shown in FIG. 7, a bracket 600 has a C-shaped cross section and has a pair of side wall portions 620 and a bottom portion 621 which connects the side wall portions 620. A protruding portion 622 is formed by cutting and raising the bottom portion 621 to protrude from the bottom portion 621 and contact the side plate 300.

According to the second embodiment, the cavity 500 is formed between the bracket 600 and the radiator tank cap 223 to improve the rigidness of the bracket 600 and the side plate 300. Further, since the bracket 600 does not contact the radiator tank 220, heat is further restricted from being transmitted from the high temperature radiator tank 220 to the low temperature condenser tank 120.

While the first and second embodiments have been described above, many variations of these embodiments may be realized without departing from the scope of the present invention.

For example, in the first embodiment, the bracket 400 is partially inserted into only the radiator tank 220. However, the bracket 400 may be partially inserted into only the condenser tank 120, or into both the condenser tank 120 and the radiator tank 220.

Also, in the first and second embodiments, the cavity 500 may be formed between the condenser tank cap 123 and the bracket 400 and/or between the radiator tank cap 223 and the bracket 400.

Further, in the first and second embodiments, the cavity 500 may be filled with material such as resin or rubber, which has a small thermal transmission coefficient and is excellent in heat insulation.

Further, at least one of the condenser and radiator tanks 120, 220 and the bracket 400 may be clad with coating material to form a heat insulation portion.

In addition, a sub-cooler (super cooling device) for increasing super cooling degree of condensed refrigerant or a receiver for separating refrigerant into liquid refrigerant and gas refrigerant may be integrally formed with the condenser 100.

Also in connection with the second embodiment, the bracket 600 may be fastened to the side plate 300 by brazing, welding, clamping and so on.

Although the present invention has been fully described in connection with preferred embodiments thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. A heat exchanger comprising:

a first heat exchanger having a plurality of first tubes through which fluid flows, and a first tank disposed at an end of each of said first tubes to extend in a tank longitudinal direction perpendicular to a longitudinal direction of said first tubes and communicating with each of said first tubes;

a second heat exchanger disposed at a downstream air side of the first heat exchanger, the second heat exchanger having a plurality of second tubes through which the fluid flows and a second tank disposed at an end of each of said second tubes to extend in parallel with the tank longitudinal direction of the first tank and communicating with each of said second tubes;

a holding member disposed at an end of at least one of the first tank and the second tank in the tank longitudinal direction thereof for holding the first heat exchanger and the second heat exchanger;

a cap covering the end of the at least one of the first tank and the second tank in the tank longitudinal direction to define a space between the cap and the holding member; and a heat insulating member disposed between the holding member and the end of the at least one of the first tank and the second tank in the tank longitudinal direction thereof for restricting heat from being transmitted from the at least one of the first tank and the second tank to the holding member.

2. The heat exchanger according to claim 1, wherein the heat insulating member includes a cavity.

3. The heat exchanger according to claim 1, wherein the holding member has a heat transmission restriction member for restricting heat transmission within the holding member.

4. The heat exchanger according to claim 1, wherein the heat insulating member includes a through hole.

5. The heat exchanger according to claim 1, wherein the holding member is partially inserted into and secured to at least one of the first tank and the second tank.

6. The heat exchanger according to claim 1, further comprising:

a side plate attached to the first heat exchanger and the second heat exchanger for reinforcing the first heat exchanger and the second heat exchanger, wherein the holding member is secured to the side plate.

7. The heat exchanger according to claim 1, wherein the first heat exchanger and the second heat exchanger are adapted to be secured onto a vehicle through the holding member.

8. The heat exchanger according to claim 1, wherein the first tank and the second tank have a clearance therebetween.

9. A heat exchanger comprising:

a first heat exchanger having a plurality of first tubes through which fluid flows, and a first tank disposed at an end of each of said first tubes to extend in a tank longitudinal direction perpendicular to a longitudinal direction of said first tubes and communicating with each of said first tubes;

a second heat exchanger disposed at a downstream air side of the first heat exchanger, the second heat exchanger having a plurality of second tubes through which the fluid flows and a second tank disposed at an end of each of said second tubes to extend in parallel with the tank longitudinal direction of the first tank and communicating with each of said second tubes;

a holding member secured to an end of at least one of the first tank and the second tank in the tank longitudinal direction thereof for holding the first heat exchanger and the second heat exchanger;

a heat insulating member disposed between the holding member and the end of the at least one of the first tank and the second tank in the tank longitudinal direction thereof for restricting heat from being transmitted from the at least one of the first tank and the second tank to the holding member;

a side plate attached to the first heat exchanger and the second heat exchanger for reinforcing the first heat exchanger and the second heat exchanger, wherein:

the holding member is secured to the side plate;

the holding member has a first arm portion and a second arm portion extending toward the side plate, and a plate insertion portion disposed between the first arm portion and the second arm portion;

the first arm portion and the second arm portion are secured to the side plate; and the plate insertion portion is inserted into the side plate.

10. A heat exchanger comprising:

a first heat exchanger having a plurality of first tubes through which fluid flows, and a first tank disposed at an end of each of said first tubes to extend in a tank longitudinal direction perpendicular to a longitudinal direction of said first tubes and communicating with each of said first tubes;

a second heat exchanger disposed at a downstream air side of the first heat exchanger, the second heat exchanger having a plurality of second tubes through which the fluid flows and a second tank disposed at an end of each of said second tubes to extend in parallel with the tank longitudinal direction of the first tank and communicating with each of said second tubes;

a holding member secured to an end of at least one of the first tank and the second tank in the tank longitudinal direction thereof for holding the first heat exchanger and the second heat exchanger;

a heat insulating member disposed between the holding member and the end of the at least one of the first tank and the second tank in the tank longitudinal direction thereof for restricting heat from being transmitted from the at least one of the first tank and the second tank to the holding member;

a side plate attached to the first heat exchanger and the second heat exchanger for reinforcing the first heat exchanger and the second heat exchanger, wherein:

the holding member is secured to the side plate; and the holding member is secured to the side plate through a bolt.

11. The heat exchanger according to claim 1, wherein the holding member is a bracket.

12. A heat exchanger comprising:

a first heat exchanger having a plurality of first tubes through which fluid flows, and a first tank disposed at an end of each of said first tubes to extend in a tank longitudinal direction perpendicular to a longitudinal direction of said first tubes and communicating with each of said first tubes;

a second heat exchanger disposed at a downstream air side of the first heat exchanger, the second heat exchanger having a plurality of second tubes through which the fluid flows and a second tank disposed at an end of each of said second tubes to extend in parallel with the tank longitudinal direction of the first tank and communicating with each of said second tubes;

a holding member secured to an end of at least one of the first tank and the second tank in the tank longitudinal direction thereof for holding the first heat exchanger and the second heat exchanger;

a heat insulating member disposed between the holding member and the end of the at least one of the first tank and the second tank in the tank longitudinal direction thereof for restricting heat from being transmitted from the at least one of the first tank and the second tank to the holding member, wherein:

the holding member has a heat transmission restriction member for restricting heat transmission within the holding member;

the holding member is a bracket;

the heat transmission restriction member is a pin; and the pin is brazed to the bracket.

* * * * *